US006488215B2

(12) United States Patent
Mohr

(10) Patent No.: US 6,488,215 B2
(45) Date of Patent: Dec. 3, 2002

(54) TWO-BLOCK CONCRETE RAILROAD TIE FOR A FIXED RAIL CARRIAGEWAY

(75) Inventor: Winfried Mohr, Neumarkt (DE)

(73) Assignee: Pfleiderer Infrastrukturtechnik GmbH & Co., KG, Neumarkt (DE)

( * ) Notice: Subject to any disclaimer, the term of this patent is extended or adjusted under 35 U.S.C. 154(b) by 0 days.

(21) Appl. No.: 09/929,168

(22) Filed: Aug. 14, 2001

(65) Prior Publication Data

US 2002/0033421 A1 Mar. 21, 2002

(30) Foreign Application Priority Data

Sep. 20, 2000 (DE) ..... 100 46 479

(51) Int. Cl.[7] ..... E01B 5/00
(52) U.S. Cl. ..... 238/2; 238/115; 238/117
(58) Field of Search ..... 238/2, 5, 9, 27, 238/29, 30, 31, 35, 38, 40, 41, 50, 83, 85, 86, 91, 92, 109, 115, 117

(56) References Cited

U.S. PATENT DOCUMENTS

| | | | | | |
|---|---|---|---|---|---|
| 849,721 | A | * | 4/1907 | Blessing | 238/115 |
| 1,042,071 | A | * | 10/1912 | Bates | 238/117 |
| 1,344,676 | A | * | 6/1920 | Burch | 238/117 |
| 1,443,253 | A | * | 1/1923 | Falk | 238/115 |
| 1,460,115 | A | * | 6/1923 | Stent | 238/117 |
| 5,551,631 | A | * | 9/1996 | Cailliau | 238/109 |

* cited by examiner

*Primary Examiner*—Mark T. Le
(74) *Attorney, Agent, or Firm*—Jordan and Hamburg LLP

(57) ABSTRACT

A two-block concrete railroad tie for a fixed rail carriageway with an at least partially continuous reinforcement, which is exposed between the blocks and, after alignment, engages the sealing compound over a supporting layer, becoming anchored in it, the blocks being provided with a mounting surface, which is shortened in the longitudinal direction and from which slanting side surfaces extend upward at least at the front side.

13 Claims, 1 Drawing Sheet

TWO-BLOCK CONCRETE RAILROAD TIE FOR A FIXED RAIL CARRIAGEWAY

BACKGROUND OF THE INVENTION

Figure 1:
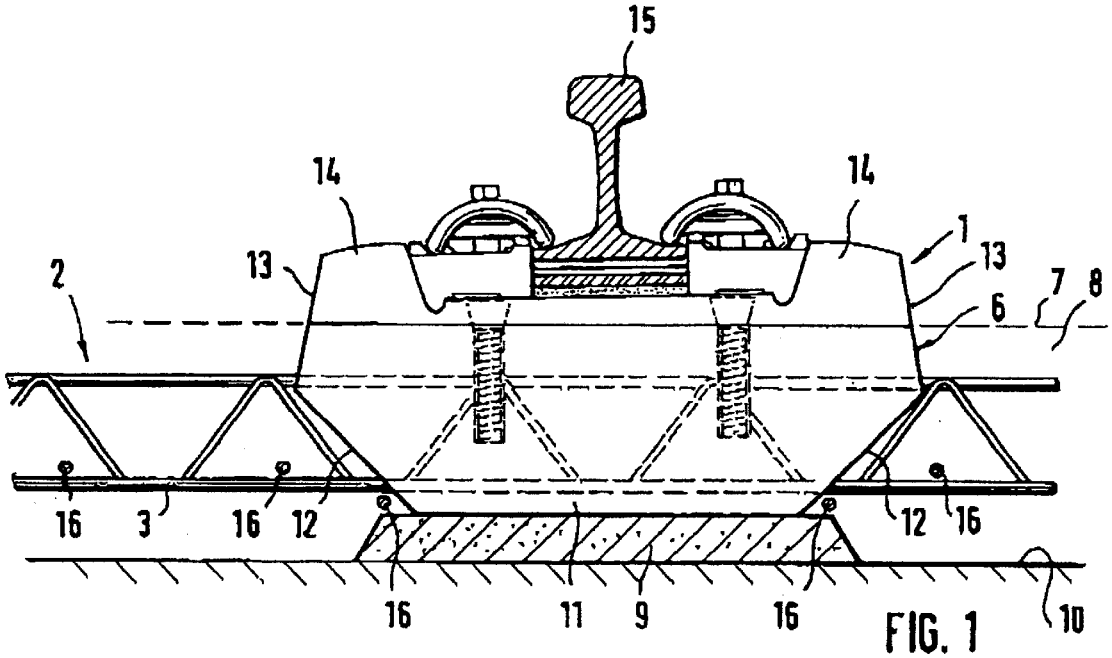

The invention relates to a two-block concrete railroad tie for a fixed rail carriageway with an at least partially continuous reinforcement, which is exposed between the blocks and, after alignment, engages the sealing compound over a supporting layer, becoming anchored in it.

Such two-block concrete railroad ties with different types of continuous reinforcement have already frequently been proposed and are also on the market in different embodiments. Such a railroad tie, as well a method for installing a fixed rail carriageway using such railroad ties are described in the German Offenlegungsschrift DE 196 53 858 A1. For the installation, the concrete railroad ties, carrying the rails or auxiliary rails, are pre-mounted into a rail, adjusted with respect to position and height over the supporting layer, which usually is not reinforced, lean concrete layer and finally embedded in a sealing compound. Aside from the embodiments, in which part of the reinforcement protrudes from the bottom of the only partly concreted railroad tie blocks, as a result of which a particularly intimate anchoring of the railroad ties in the sealing compound is achieved, the proposal has also already been made in an older application to mold a placement concrete block, which protrudes downward beyond the reinforcement, to the underside of the concrete, which envelops the railroad tie block, for placing the railroad tie on the supporting layer. However, as with all railroad ties with pre-alignment, for which the sealing composition must also be brought in under the railroad ties, which are disposed at a greater or lesser distance above the supporting layer, the difficulty arises that a continuous, simultaneous casting of the railroad ties of a railroad tie grid is not possible and, instead, must take place section by section, since it otherwise cannot be ensured that the sealing composition fills up the space under the railroad ties and that bubbles cannot be formed by the air present there.

SUMMARY OF THE INVENTION

It is therefore an object of the invention to configure a two-block concrete railroad tie of the type named above in such a manner, that a simultaneous casting of adjacent railroad tie sections and, with that, the casting of a rail grid in one step is possible without the danger of air inclusions.

Pursuant to the invention, the blocks are provided with a placement surface, which is shortened appreciably in the longitudinal direction and from which, at least at the front side, slanting side surfaces extend upward. Before the aligning, the placement surface initially serves for depositing the railroad tie directly on the supporting layer. After the alignment, the placement surface is connected by a layer of adhesive, which is about 2 to 8 cm thick, with the supporting layer. During the subsequent casting, it is no longer necessary to take care that the air below the railroad ties escapes since, after all, the adhesive layer is present here. Air can also not be collected at the sides, as is the case with constructions with the integrally molded placement concrete blocks, since the air can be displaced without difficulties over the slanted side surfaces. Because the side surfaces are inclined preferably an angle of 45°, the vertical forces are introduced advantageously into the supporting layer, optionally an open box plate, with a load distribution of 45° over the carriageway plate. The slanted side surfaces shall be profiled rather encasement-smooth in order to have a better connection later on with the enveloping concrete.

The slanted side surfaces and the placement surface, which is shortened in the longitudinal direction of the railroad ties, are particularly advantageous for the introduction of the longitudinal iron rods into the fixed carriageway, that is, the longitudinal reinforcing iron rods, which are aligned perpendicularly to the axis of the railroad ties, since these reinforcing iron rods do not need to be disposed relatively far apart by the blocks, as in the case of conventional two-block concrete railroad ties. Because the surfaces are slanted, the longitudinal iron rods, which are disposed immediately to the side of the blocks, can lie very much closer to one another than in the case of conventional embodiments.

In a development of the invention, provisions can be made so that steep, oppositely inclined upper front surface sections adjoin the slanted, inwardly inclined side surfaces—the strong counter-conicity prevents the whole block being pulled out—in much the same way as they are conventionally present continuously from the upper side to the underside of the blocks, it being possible to dispose the upper front surface sections directly next to the support shoulders, so that a shortening of the blocks results once again overall. As a result of this additional reduction in the volume of the blocks of an inventive two-block concrete railroad tie, the latter is very much lighter and therefore can be handled better and that, in particular, because of the lower weight, rail grids of such two-block concrete railroad ties can be handled more easily and aligned over the supporting layer and glued to the latter.

Further advantages, distinguishing features and details of the invention arise out of the following description of an example, as well as from the drawings.

IN THE DRAWINGS

Figure 2:
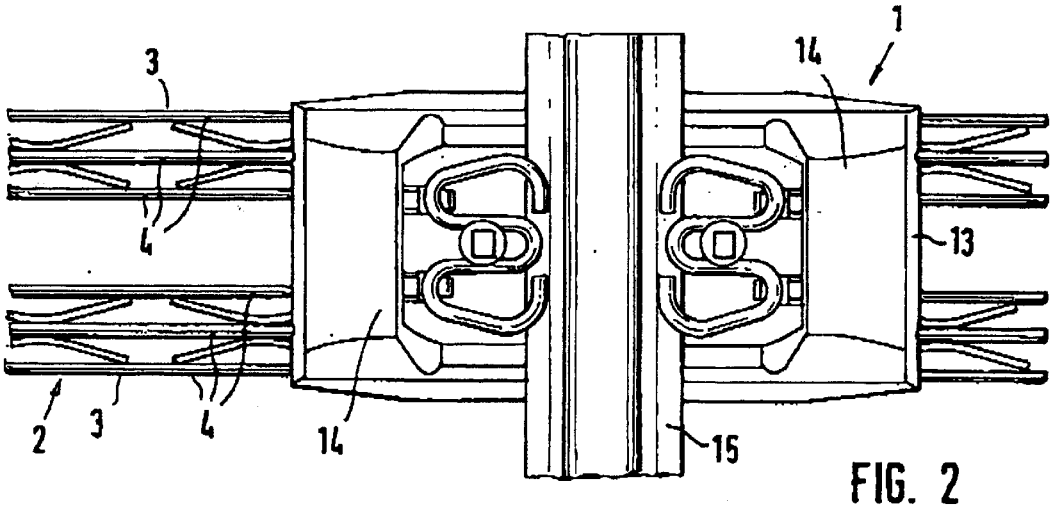
Figure 3:
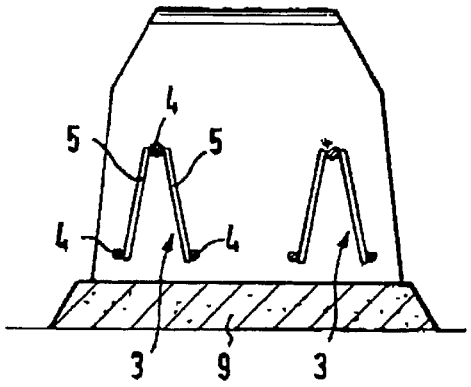

FIG. 1 shows a the view of one half of an inventive two-block concrete railroad tie, FIG. 2 shows a plan view of half the two-block concrete railroad tie of FIG. 1, and FIG. 3 shows a front view of the two-block concrete railroad tie of FIGS. 1 and 2.

DESCRIPTION OF THE PREFERRED EMBODIMENTS

The inventive two-block concrete railroad tie comprises two individual blocks 1, which are connected by a continuous reinforcement 2, which is exposed between the blocks 1. In the example shown, the reinforcement 2 consists of two trellis supports 3, which are disposed parallel to one another and may be formed in each case of three longitudinal iron rods 4, which are parallel to the axis of the railroad tie and, connecting these, of meandering, serpentine pipes 5 or of diagonal members, resolved into individual triangles. On the outer front sides 6, the trellis supports 3 protrude also still on the outer front sides 6 from the blocks 1, so that also there the tying into the sealing compound 8, which extends up to the plane 7, is good and, moreover, the protruding sections of the trellis supports can also be engaged by supporting and aligning elements.

Pursuant to the invention, the blocks 1 are constructed so that they have such a thickness, that they can be glued with the help of a 2 to 8 cm thick adhesive layer 9 directly on the supporting layer 10. The lower mounting surface 11 is constructed shortened in the longitudinal direction parallel to the trellis supports 3 and slanting side surfaces 12 extend upward at the front end from the mounting surface 11 and, approximately at half the height of the blocks 1, change over into steep, oppositely inclined, upper front surface sections 13. As far as possible, these front surface sections 13 should be disposed directly next to the supporting shoulders 14 of the blocks 1, between which the usual support and the known clamping and fastening devices for the rails 15 are located. These fastening elements and support shoulders are known adequately and are not an object of the present invention, so that they need not be described in detail.

Due to the slanting side surfaces 12 in conjunction with the shortened construction of the mounting surface 11, the longitudinal iron bars 16 can be disposed very much closer to one another next to the blocks than they can in the case of conventional blocks without this contracted construction over the slanting side surfaces 12.

What is claimed is:

1. A fixed rail carriageway arranged on a supporting layer, comprising:

a plurality of railroad ties spaced apart from one another, each of said railroad ties comprising two concrete blocks spaced apart from one another and a reinforcement system connecting and reinforcing said blocks, each of said blocks having an inner side and an outer side whereby said inner sides of said blocks are opposite one another and each of said blocks having a lower mounting surface and a first outer side surface which extends upward from said lower mounting surface and outward in a direction away from said inner side;

rails arranged on said blocks; and adhesive layers adapted to be arranged directly on the supporting layer, said lower mounting surfaces of blocks resting on said adhesive layers such that said blocks are connected to said adhesive layers.

2. The fixed rail carriageway of claim 1, wherein said adhesive layers have a thickness of 2 cm to 8 cm.

3. The fixed rail carriageway of claim 1, further comprising reinforcing rods extending in a longitudinal direction of said rails and being arranged between said blocks.

4. The fixed rail carriageway of claim 1, wherein said first outer side surfaces of said blocks are profiled.

5. The fixed rail carriageway of claim 1, wherein said first outer side surfaces of said blocks extend upward at an angle of about 45°.

6. The fixed rail carriageway of claim 1, wherein each of said blocks has a second, inwardly inclined outer side surface adjoining said first outer side surface.

7. The fixed rail carriageway of claim 6, wherein each of said blocks includes two supporting shoulders for supporting one of said rails therebetween, said second outer side surfaces of said blocks being arranged directly alongside one of said supporting shoulders.

8. The fixed rail carriageway of claim 1, wherein each of said blocks has a first inner side surface which extends upward from said lower mounting surface and inward in a direction toward the other of said blocks in said railroad tie.

9. The fixed rail carriageway of claim 8, wherein each of said blocks has a second inner side surface adjoining said first inner side surface, said second inner side surface being inclined outward in a direction away from the other of said blocks in said railroad tie.

10. The fixed rail carriageway of claim 9, wherein each of said blocks includes two supporting shoulders for supporting a rail support therebetween, said second inner side surfaces of said blocks being arranged directly alongside one of said supporting shoulders.

11. The fixed rail carriageway of claim 1, wherein said lower mounting surface and said first outer side surfaces of said blocks are constructed such that a length of each of said blocks in the longitudinal direction of the railroad tie is smaller at said lower mounting surface than at an upper end of said first outer side surfaces.

12. The fixed rail carriageway of claim 1, wherein said reinforcement system comprises two trellis supports, each of said trellis supports comprising three rods and serpentine pipes connecting said rods.

13. The fixed rail carriageway of claim 1, wherein said first outer side surfaces of said blocks extend upward a distance about one-half of the height of said blocks.

* * * * *